US007328796B2

(12) United States Patent
Brunson et al.

(10) Patent No.: US 7,328,796 B2
(45) Date of Patent: Feb. 12, 2008

(54) TOOL HOLDER INSERT FOR STORAGE CONTAINER

(75) Inventors: Mark E. Brunson, Bel Air, MD (US); Michael P. Peters, Lutherville, MD (US); Don C. Freeman, Havre De Grace, MD (US)

(73) Assignee: Black & Decker Inc., Newark, DE (US)

( * ) Notice: Subject to any disclaimer, the term of this patent is extended or adjusted under 35 U.S.C. 154(b) by 156 days.

(21) Appl. No.: 11/113,907

(22) Filed: Apr. 25, 2005

(65) Prior Publication Data

US 2006/0243617 A1 Nov. 2, 2006

(51) Int. Cl.
*B65D 85/20* (2006.01)
*B65D 5/50* (2006.01)
*A47F 7/00* (2006.01)

(52) U.S. Cl. ..... 206/373; 206/379; 206/743; 206/759; 211/69

(58) Field of Classification Search ..... 206/372–373, 206/376–379, 743–744, 747–748, 759, 349–370; 211/69, 70.6, 70.7
See application file for complete search history.

(56) References Cited

U.S. PATENT DOCUMENTS

| | | | | |
|---|---|---|---|---|
| 3,578,153 | A * | 5/1971 | Olson | 206/379 |
| 3,870,149 | A * | 3/1975 | Huot | 206/379 |
| 5,570,784 | A | 11/1996 | Sidabras et al. | |
| 5,626,227 | A | 5/1997 | Wagner et al. | |
| 6,047,827 | A * | 4/2000 | Huang | 206/379 |
| 6,050,409 | A * | 4/2000 | Delbeck et al. | 206/379 |
| 6,119,859 | A | 9/2000 | Wen | |
| 6,213,296 | B1 * | 4/2001 | Streich et al. | 206/373 |
| 6,405,864 | B1 | 6/2002 | Streich et al. | |
| 6,755,302 | B1 * | 6/2004 | Streich et al. | 206/373 |
| 6,953,114 | B2 * | 10/2005 | Wang | 206/375 |
| 2003/0141211 | A1 | 7/2003 | Tsai | |
| 2004/0188366 | A1 | 9/2004 | Tong | |
| 2005/0077198 | A1 * | 4/2005 | Wikle et al. | 206/373 |
| 2006/0201835 | A1 * | 9/2006 | Shih | 206/373 |

FOREIGN PATENT DOCUMENTS

| | | |
|---|---|---|
| DE | 1893098 | 5/1964 |
| DE | 29609483 | 11/1996 |
| DE | 297 22 562 | 3/1998 |
| DE | 19955409 A1 | 6/2001 |
| DE | 20117576 U1 | 2/2002 |
| EP | 0199080 | 3/1986 |

* cited by examiner

*Primary Examiner*—Bryon P Gehman
(74) *Attorney, Agent, or Firm*—Harness, Dickey & Pierce, P.L.C.

(57) ABSTRACT

A tool holder insert for use with storage containers is provided including a base portion and a sleeve. The base portion has a first end and a second end. The first end includes an interlock feature adapted to be a non-rotatably coupled to the storage container. The sleeve is rotatably coupled to the base between the first and second ends. A specialized tool accessory is supported within the storage container by the tool holder insert.

20 Claims, 4 Drawing Sheets

TOOL HOLDER INSERT FOR STORAGE CONTAINER

FIELD OF THE INVENTION

The present invention relates to tool containers and, more specifically, to inserts which are adapted to be retained within the containers.

BACKGROUND OF THE INVENTION

Tool users, whether casual or professional, desire to maintain their tools in some type of organized fashion that provides for easy access to the tools. Several types of tool containers serve such a function.

While the tool containers work satisfactorily for their intended design purpose, these containers have their drawbacks. One such drawback is the lack of ability to reconfigure the location or type of the tool holder within the container. Another drawback is the inability to provide easy access to the tools once the tools are in the tool container and the inability to store specialized tool accessories therein.

SUMMARY OF THE INVENTION

Accordingly, a tool holder insert is provided that is selectively located in a storage container for storing a tool holder therein. The tool holder insert includes a base portion and a sleeve. The base portion has a first end and a second end. The first end includes an interlock feature adapted to be non-rotatably coupled to a storage container. The sleeve is rotatably coupled to the base between the first and second ends.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment is merely exemplary in nature and is in no way intended to limit the invention, its application, or uses.

Figure 1:
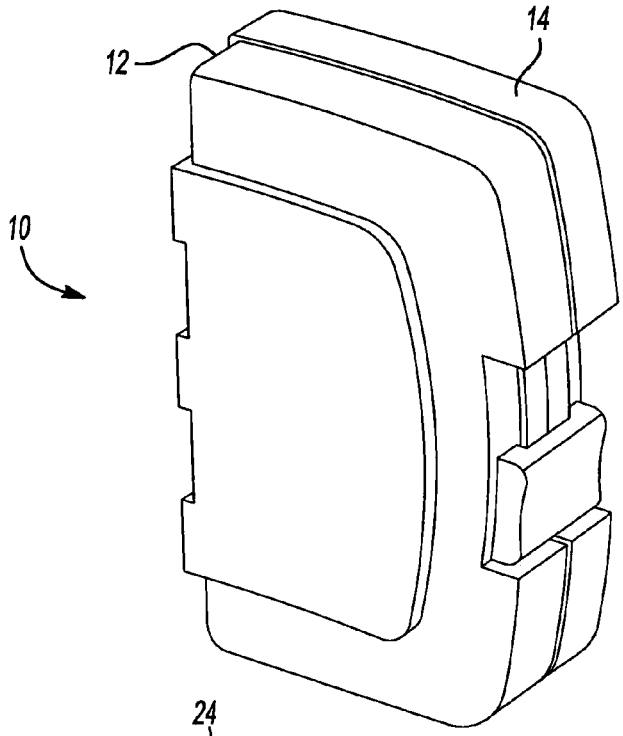
FIG. 1 is a perspective view of a tool container of the present invention in a closed position.
Figure 2:
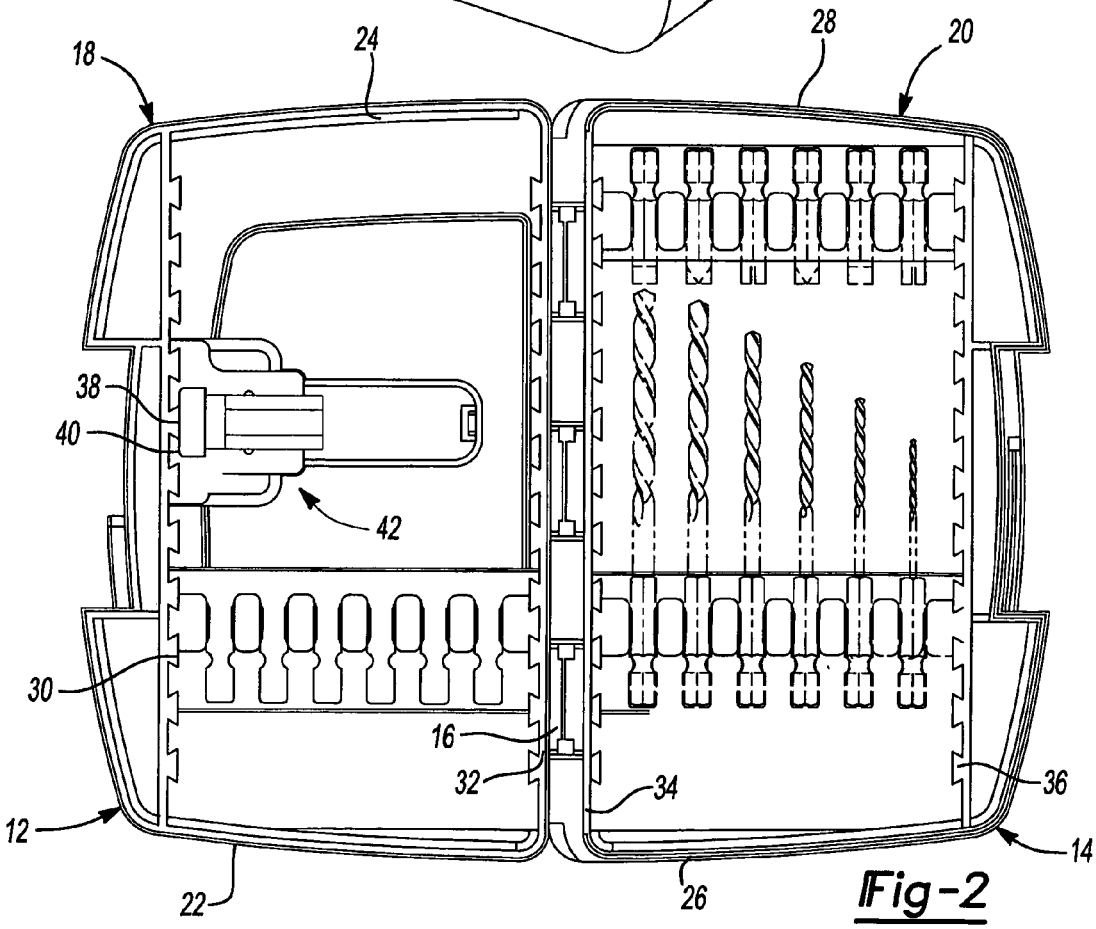
FIG. 2 is a plan view of the tool container of the present invention in an open position.

FIGS. 1 and 2 show a tool container 10 having two housing members 12, 14 which are pivotally secured to one another by a hinge 16. The housing members 12, 14 include peripheral walls 18, 20 defining lateral walls 22, 24; 26, 28 and longitudinal walls 30, 32; 34, 36. The longitudinal walls 30, 32; 34, 36 include a plurality of dovetail tenons 38 and recesses 40 that define interlock features. It should be understood that other interlock features can also be used. The structure of the exemplary tool container 10 is described in more detail in commonly assigned U.S. Pat. No. 6,755,302, herein incorporated by reference. The insert 42 of the present invention is shown in engagement with the dovetail tenons 38.

FIGS. 3-8 depict an exemplary preferred embodiment of an insert 42 supporting a bit holder 44 according to the teachings of the present invention, shown merely for purposes of illustration. One skilled in the art will readily recognize, from the following discussion and accompanying drawings, a variety of specialized inserts can advantageously employ the principles of the present invention.

Figure 3:
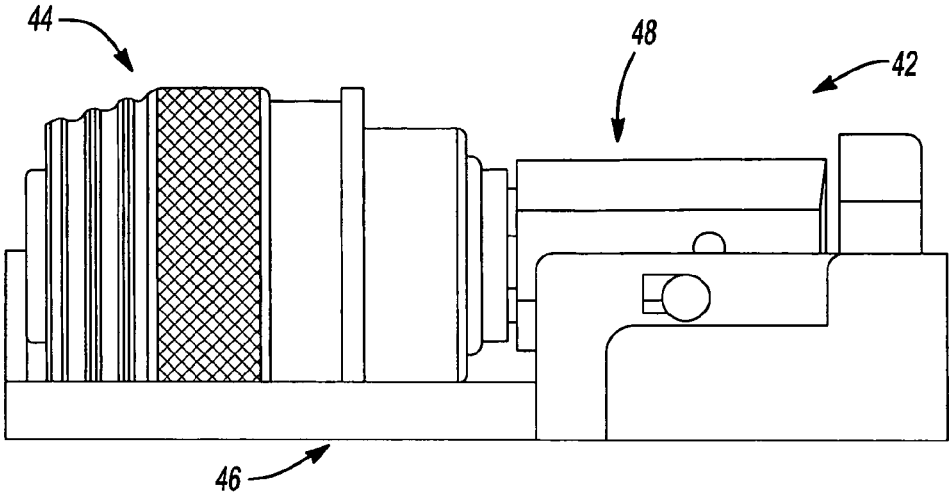
FIG. 3 is a side plan view of the insert of the present invention in a storage position.
Figure 4:
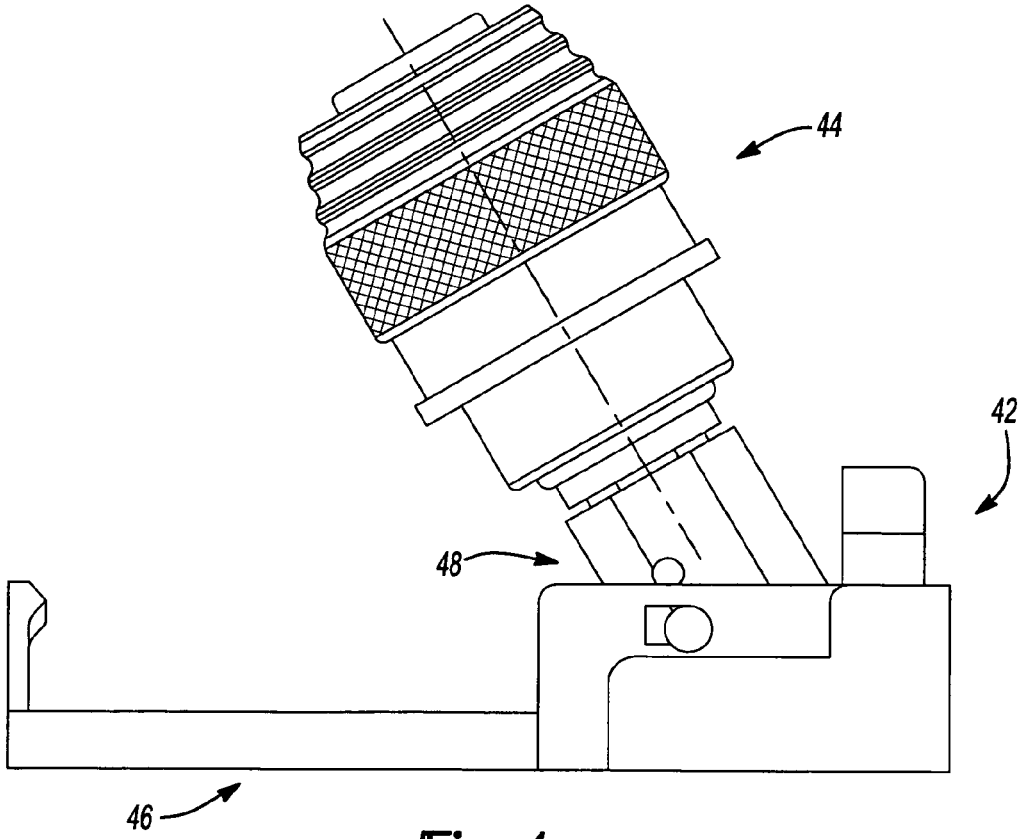
FIG. 4 is a side plan view of the insert of FIG. 3 in an access position.
Figure 8:
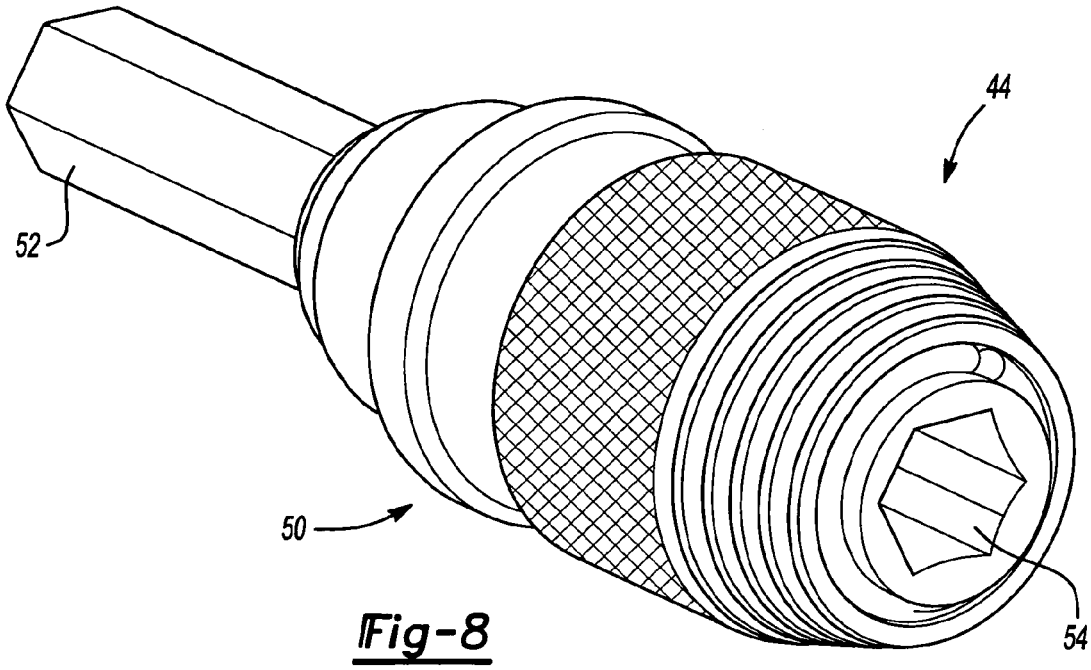
FIG. 8 is a perspective view of an exemplary tool retained by the insert in FIG. 3.

FIGS. 3, 4 and 8 show the insert 42 and a bit holder 44 in greater detail. The insert 42 includes a base 46 and a sleeve 48. The insert 42 provides storage for the bit holder 44. The sleeve 48 retains the bit holder 44 and is pivotally supported by the base 46 providing a storage position (shown in FIG. 3) and an access position (shown in FIG. 4). As best shown in FIG. 8, the bit holder 44 includes a body 50 having a hex shank 52 extending therefrom. A hex-shaped bore 54 is formed in the body 50, with the bore 54 opening axially outwardly toward the front of the bit holder 44. The structure of the bit holder 44 is described in more detail in commonly assigned U.S. Patent Application No. 2003/0230862A1, herein incorporated by reference. It should be noted that while the description of the invention includes an insert 42 accommodating a bit holder 44, it should be understood by one of skill in the art that a variety of other tools could be conveniently stored requiring only slight modifications to the present invention.

Figure 5:
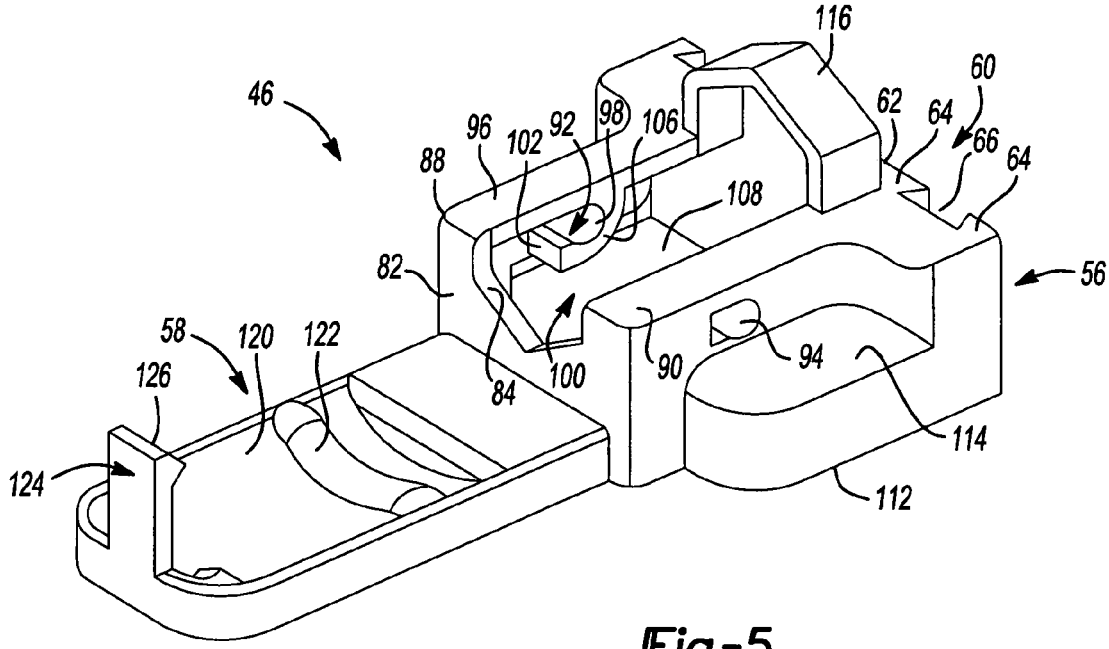
FIG. 5 is a perspective view of the base of the insert of FIG. 3.
Figure 6:
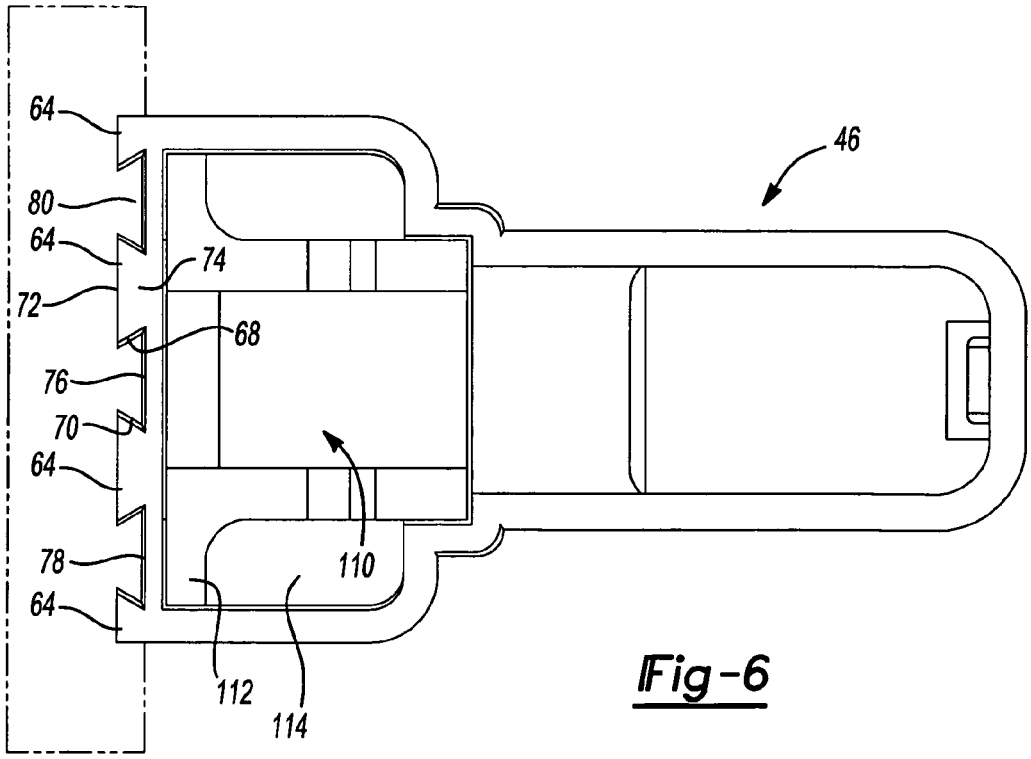
FIG. 6 is a bottom plan view of the base in FIG. 5.

FIGS. 3-6 show the base 46 of the insert 42 in greater detail. As best shown in FIGS. 5 and 6, the base 46 includes a first end 56 and a second end 58. The first end 56 is removably coupled to the tool container 10 at a rear wall 60. The rear wall 60 includes a rear surface 62 having a plurality of tenons 64 and recesses 66 to mate, respectively, with the dovetail tenons 38 and recesses 40 (shown in FIG. 2) provided on the longitudinal walls 30, 32, 34, 36 of the tool container 10. The tenons 64 have angled walls 68, 70. Also, the tenons 64 are larger at the top 72 and smaller at the bottom 74 to provide an overall trapezoidal shape. The recesses 66 are defined by the walls 68, 70 of the tenons 64 and include a rear wall 76. The recesses 66 are larger at the bottom 78 and smaller at the top 80 to provide an overall trapezoidal shape. Thus, the tool retaining insert 42 is positioned inside of the housing members 12, 14 so that a friction fit is maintained between the housing members 12, 14 and the insert 42. The friction is such that the tool retaining insert 42 is substantially fixedly maintained within the tool container 10.

A front wall 82 is located between the rear wall 60 and the second end 58 of the base 46. The front wall 82 includes a V-shaped recessed cradle 84 for receiving the hexagonal shaped outer surface 86 of the sleeve 48. A pair of sidewalls 88, 90 extend from the base 46 at the first end 56 and connect the front 82 and rear 60 walls. The sidewalls 88, 90 are generally perpendicular to the rear wall 60 and include a series of pivot receptors 92, 94 for engagement with the sleeve 48.

The pivot receptors 92, 94 extend generally inwardly from the sidewalls 88, 90 and generally below the upper sidewall surface 96. The pivot receptors 92, 94 are generally identical, therefore only one pivot receptor 92 will be described in detail. The pivot receptor 92 includes an aperture 98 passing through the sidewall 88 and a protrusion 100 partially surrounding the aperture 98. A first portion 102 of the protrusion 100 is located a distance slightly less than the diameter of one of the arms 104 of the sleeve 48, providing a snap fit for the arm 104 between the upper sidewall surface 96 and the first portion 102. A second portion 106 of the protrusion 100 has a generally arcuate shape and is sized similar to the arm 104, having a slightly larger diameter than that of the arm 104, allowing the arm 104 to freely rotate therein.

A chamber 108 is defined by the series of sidewalls 88, 90 and the front 82 and rear 60 walls and generally houses a portion of the sleeve 48. The chamber 108 further includes an aperture 110 extending through the base 46, allowing the sleeve 48 to pass therethrough from the lower surface 112 to the chamber 108. The aperture 110 generally extends between the sidewalls 88, 90, rear wall 60 and front wall 82. A side portion 114 of the base 46 extends outwardly from each of the sidewalls 88, 90. The side portion 114 generally extends the length of the sidewalls 88, 90 and connects with the rear wall 60. An upper wall portion 116 extends from the rear wall 60 and has a semi-hexagonal shape.

An elongated portion extends from the front wall 82 in a direction generally opposite the recess 108 and generally defines the second end 58. The second end 58 is generally rectangular and includes an arcuate recess 120 for housing the bit holder 44. The arcuate recess 120 has a rib 122 disposed therein to support a portion of the body 50 of the bit holder 44. The base 46 further includes a finger 124 located at the second end 58. The finger 124 extends generally upward from the lower surface 112 of the base 46 to a height generally equal to the height of the bore 54 of the bit holder 44 when in a storage position. The finger 124 includes a top portion 126 extending toward the first end 56 and partially into the bore 54 of the bit holder 44, providing engagement between the base 46 and bit holder 44 retained in the sleeve 48 so that the bit holder 44 cannot become inadvertently dislodged from the sleeve 48.

Figure 7:
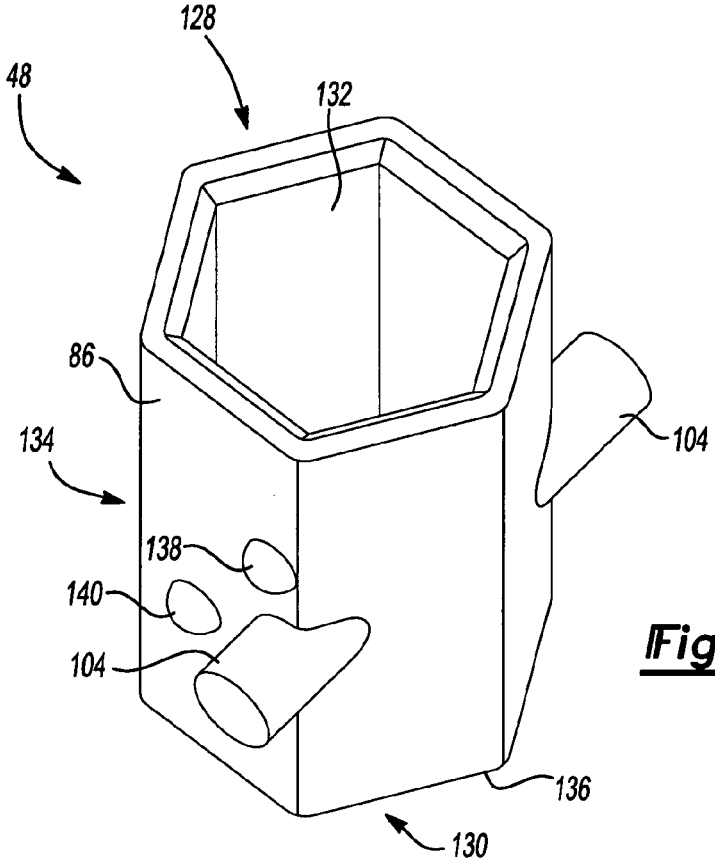
FIG. 7 is a perspective view of the sleeve of the insert of FIG. 3.

The sleeve 48 is shown in greater detail in FIGS. 3-4 and 7. The sleeve 48 includes a body 134 having a first end 128, a second end 130 and a recess 132 extending partially into the body 134 of the sleeve 48 from the first end 128. The second end 130 includes a wall 136 defining a stop for the recess 132. The hex shank 52 of the bit holder 44 is housed in the sleeve 48. The sleeve 48 has a generally hexagonal outer surface 86 and a generally hexagonal inner recess 132, thereby accommodating the hex shank 52 of the bit holder 44. The sleeve 48 may be inserted into the chamber 108 through the aperture 110 through the lower surface 112. A series of generally cylindrical arms 104 extend from a medial portion of the sleeve 48 and are able to be snapped into the pivot receptors 92, 94 in the sidewalls 88, 90 after the sleeve 48 is inserted through the aperture 110 in the chamber 108 at the first end 56. Once the arms 104 are snapped into the pivot receptors 92, 94, the sleeve 48 is pivotally supported by the base 46. The upper sidewall surface 96 prevents the sleeve 48 from being removed from the top.

The V-shaped cradle 84 of the base 46 allows the first end 56 of the sleeve 48 to rest thereon, thereby supporting the sleeve 48 in a storage position. A series of projections 138, 140 extend outwardly from the body 134 of the sleeve 48. These projections 138, 140 serve as stops, allowing the sleeve 48 to be indexed between a horizontal position (shown in FIG. 3) with respect to the base 46 and an angularly upright position (shown in FIG. 4). This is achieved through the projections 138, 140 extending from the sleeve 48 a distance greater than the distance defined between the upper sidewall surfaces 96, causing an interference fit. The projections 138, 140 rest on the upper sidewall surface 96 unless forced past this position, creating the indexing mentioned above. A first series of projections 138 are disposed between the arms 104 and the first end 56 and are slightly above the arms 104 when in a storage position, providing indexing for an angularly upright position. A second series of projections 140 are located between the arms 104 and the second end 58 and above the first series of stops 138 when the sleeve 48 is in a storage position.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A tool container comprising:

two housing members pivotally coupled with one another for opening and closing with respect to one another, at least one of said housing members defining a respective cavity for receiving tools, each said cavity defined by a base and a sidewall extending around the perimeter of said base, said sidewall having a first plurality of interlocking features;

a base portion having a first end and a second end, said first end including a second interlocking feature adapted to be non-rotatably engaged to at least one of said first plurality of interlocking features on said sidewall at a plurality of distinct positions along said sidewall; and a sleeve rotatably coupled to said base portion between said first and second ends and movable between a storage position and a use position, said sleeve including at least one arm extending therefrom and received by said sidewall wherein said at least one arm is precluded from lateral movement during rotation of said sleeve between said storage and use positions.

2. The tool container of claim 1, further comprising at least one projection adapted to index said sleeve between a position generally parallel to said base portion in said storage position and an angularly upright position relative to said base in said access position through contact with said sidewall through an interference fit with said sidewall.

3. The tool container of claim 1, wherein said first end of said base portion is adapted to be engaged to an interior wall of the tool container.

4. The tool container of claim 3, wherein said first and second interlocking features define complementary dove tail tenons.

5. The tool container of claim 1 wherein said second end of said base portion includes a finger extending therefrom adapted to engage an end of a tool in said sleeve for preventing the tool from becoming inadvertently dislodged from said sleeve.

6. The tool container of claim 1 wherein said base portion is adapted to be removably attached to the tool container.

7. The tool container of claim 1, wherein said sleeve has a generally hexagonal bore.

8. A tool holder insert comprising:

a base portion having a first end and a second end, said first end including an interlock feature adapted to be non-rotatably engaged to a storage container, at least one sidewall located between said first and second ends generally extending from said base portion; and a sleeve rotatably coupled to said base portion between said first and second ends and movable between a storage position and an access position, said sleeve including at least one arm extending therefrom, wherein said sleeve rotates about said at least one arm between said storage and access positions, said sleeve further defining a first protection that engages said at least one sidewall of said base portion in said access position to stop said sleeve at an angularly upright position.

9. The tool holder insert of claim 8, wherein said at least one projection is adapted to index said sleeve between a position generally parallel to said base portion in said storage position and said angularly upright position in said access position relative to said base portion through an interference fit with said at least one sidewall.

10. The tool holder insert of claim 9 wherein said at least one projection rests atop said at least one sidewall of said base portion in said access position.

11. The tool holder insert of claim 10 wherein said at least one projection includes two projections and said at least one sidewall includes two opposing sidewalls, wherein a first distance is defined between said two projections and a second distance is defined between said two opposing sidewalls, said first distance being greater than said second distance.

12. The tool holder insert of claim 8, wherein said first end of said base portion is adapted to be engaged to an interior wall of a storage container.

13. The tool holder insert of claim 12, wherein said first end of said base portion includes at least one dove tail tenon adapted to engage at least one dove tail tenon on the interior wall of the storage container.

14. The tool holder insert of claim 8, wherein said second end of said base portion includes a finger extending therefrom adapted to engage an end of a tool in said tool holder insert for preventing the tool from becoming inadvertently dislodged from said sleeve.

15. The tool holder insert of claim 8, wherein said base portion is adapted to be removably attached to the storage container.

16. A tool container comprising:

two housing members pivotally coupled to one another for opening and closing with respect to one another, at least one of said housing members having a cavity for receiving tools, each said cavity defined by a base and a wall extending around the perimeter of said base, said wall including a plurality of first interlocking features; and an insert for retaining tools, said insert including a base portion having a first end and a second end, said first end including a second interlocking feature adapted to be selectively engaged to at least one of said plurality of first interlocking features at a first location and selectively engaged to at least another of said plurality of first interlocking features at a second distinct location along said wall and a sleeve rotatably coupled to said base portion.

17. The tool container of claim 16, wherein each of said plurality of first interlocking features includes a first dove tail tenon and said second interlocking feature includes a second dove tail tenon, said first and second dove tail tenons adapted to fixedly engage one another.

18. The tool container of claim 16, wherein said sleeve includes at least one projection extending outwardly from said sleeve, said at least one projection adapted to index said sleeve between a position generally parallel to said base portion and an angularly upright position relative to said base portion through an interference fit with a sidewall of said base portion.

19. The tool container of claim 16, wherein said second end of said base portion includes a finger extending therefrom adapted to engage an end of a tool in said insert for preventing the tool from becoming inadvertently dislodged from said sleeve.

20. The tool container of claim 16 wherein said sleeve includes an arm rotatably captured at a pivot receptor formed in said insert wherein said arm is constrained from lateral movement by said pivot receptor during rotation of said sleeve relative to said insert.

* * * * *

UNITED STATES PATENT AND TRADEMARK OFFICE

CERTIFICATE OF CORRECTION

PATENT NO. : 7,328,796 B2
APPLICATION NO. : 11/113907
DATED : February 12, 2008
INVENTOR(S) : Mark E. Brunson et al.

It is certified that error appears in the above-identified patent and that said Letters Patent is hereby corrected as shown below:

Title Page,
Item (57) Abstract, line 4, delete "a".

Column 5,
Line 10, "protection" should be --projection--.

Signed and Sealed this

Tenth Day of March, 2009

John Doll

JOHN DOLL
*Acting Director of the United States Patent and Trademark Office*